US008662340B2

(12) United States Patent
Cocchiarella

(10) Patent No.: US 8,662,340 B2
(45) Date of Patent: Mar. 4, 2014

(54) PORTION CONTROL PLATE COVER

(75) Inventor: Patricia Cocchiarella, Burnsville, MN (US)

(73) Assignee: Patricia Cocchiarella, Burnsville, MN (US)

( * ) Notice: Subject to any disclaimer, the term of this patent is extended or adjusted under 35 U.S.C. 154(b) by 0 days.

(21) Appl. No.: 13/306,410

(22) Filed: Nov. 29, 2011

(65) Prior Publication Data

US 2012/0067899 A1 Mar. 22, 2012

Related U.S. Application Data

(63) Continuation of application No. 12/043,320, filed on Mar. 6, 2008, now Pat. No. 8,083,090.

(60) Provisional application No. 60/896,343, filed on Mar. 22, 2007.

(51) Int. Cl.
*B65D 19/02* (2006.01)
*B65D 1/36* (2006.01)

(52) U.S. Cl.
USPC ..... 220/521; 220/556; 220/575

(58) Field of Classification Search
USPC ..... 220/521, 500, 574, 575, 555, 556
See application file for complete search history.

(56) References Cited

U.S. PATENT DOCUMENTS

| | | | | |
|---|---|---|---|---|
| 135,296 | A | 1/1873 | Thurston | |
| 948,434 | A * | 2/1910 | Scott | 220/575 |
| 1,768,976 | A | 7/1930 | Cuthbertson | |
| 2,683,974 | A * | 7/1954 | Brown | 220/574.2 |
| 3,532,247 | A * | 10/1970 | Bridges | 220/23.6 |
| 3,545,642 | A * | 12/1970 | Swett | 220/575 |
| RE28,720 | E | 2/1976 | Sediak | |
| 3,955,710 | A | 5/1976 | Commisso | |
| 4,498,508 | A | 2/1985 | Scholle et al. | |
| 4,819,862 | A | 4/1989 | Maroszek | |
| 4,966,295 | A * | 10/1990 | Parrish | 220/576 |
| 5,007,743 | A * | 4/1991 | Brennan | 374/141 |
| 5,176,282 | A | 1/1993 | Rapaz | |
| RE34,703 | E | 8/1994 | Zilliox | |
| 5,353,952 | A * | 10/1994 | Donche | 220/575 |

(Continued)

OTHER PUBLICATIONS

Portion Doctor webpage, http://www.healthportions.com/storefront/SearchResult.aspx?CategoryID=2, Jul. 10, 2006, 3 pages.

(Continued)

*Primary Examiner* — Mickey Yu
*Assistant Examiner* — Niki Eloshway
(74) *Attorney, Agent, or Firm* — Seager, Tufte & Wickhem LLC

(57) ABSTRACT

The present invention provides a device for increasing portion control in a diet. In one illustrative embodiment, the portion control device includes a cover member sized to cover at least a portion of an eating surface of a plate. The cover member may include a first surface having one or more openings therein defined by an opening perimeter. One or more compartment walls may be attached to the first surface adjacent to the perimeter of the one or more openings and may extend a distance therefrom. The openings and the compartment walls may define a portion compartment that may help to manage, and in some cases, measure, portions of food. Additionally, in some embodiments, the compartments may have labels indicating the food group to be placed therein to help achieve a balanced diet.

18 Claims, 7 Drawing Sheets

(56) References Cited

U.S. PATENT DOCUMENTS

| | | | | |
|---|---|---|---|---|
| 5,387,022 | A | 2/1995 | Soumah | |
| 5,411,186 | A | 5/1995 | Robbins, III | |
| 5,564,482 | A | 10/1996 | Grat et al. | |
| 5,857,583 | A | 1/1999 | Chantaca et al. | |
| 5,915,581 | A | 6/1999 | Pfirrmann, Jr. et al. | |
| 5,915,854 | A | 6/1999 | Burket et al. | |
| 5,918,767 | A | 7/1999 | McGill | |
| 6,026,734 | A | 2/2000 | Dadez | |
| 6,116,455 | A | 9/2000 | Rossman et al. | |
| 6,255,637 | B1 | 7/2001 | Collett | |
| 6,296,488 | B1 * | 10/2001 | Brenkus et al. | 434/127 |
| 6,440,509 | B1 | 8/2002 | Littlejohn et al. | |
| 6,733,852 | B2 | 5/2004 | Littlejohn et al. | |
| 2001/0030139 | A1 * | 10/2001 | Gagliardi, Jr. | 206/459.5 |
| 2005/0011367 | A1 | 1/2005 | Crow | |
| 2005/0242092 | A1 | 11/2005 | Sinton et al. | |
| 2006/0029695 | A1 * | 2/2006 | Kaczor | 426/87 |
| 2006/0029698 | A1 * | 2/2006 | Watson et al. | 426/231 |
| 2006/0156695 | A1 | 7/2006 | Schlitz et al. | |
| 2006/0201952 | A1 | 9/2006 | Hakim | |
| 2007/0289973 | A1 * | 12/2007 | Acosta et al. | 220/507 |
| 2008/0023482 | A1 | 1/2008 | Ricciardi | |
| 2009/0194543 | A1 | 8/2009 | Farmer | |

OTHER PUBLICATIONS e-Bay—portion control, Food Service Retail, Weight Management items on eBay.com, http://search.ebay.com/portion-control_W0QQfclZ4QQfsopZ1QQxpufuZx, Jul. 10, 2006, 5 pages.

Zuber, Inc., Portion Control Cover, http://www.zuberinc.com/pc-cover.htm, Aug. 2, 2006, 2 pages.

Amazon.com: Relaxor FF8PP Perfect Portion Control Health System, http://www.amazon.com/gp/product/B00025HFL0/102-57712000135?v=glance&n=37 . . . , Aug. 2, 2006, 5 pages.

Maytag Portion Control Dish with Cover: Diabeaters.com, http://www.diabeaters.com/Mrchant2/merchant.mv?Screen=Prod&Product_Code=LN00 . . . , Aug. 2, 2006, 1 page.

Plate Covers Custom cover stainless steel for hotels and restaurants web page, http://www.amnow.com/plateCovers/customCovers.html, Aug. 2, 2006, 3 pages.

Amazon.com: Nordic Ware Microwave Plate Cover: Kitchen & Housewares web page, http://www.amazon.com/gp/product/B00004W4UQ/102-5771200-2000135, Aug. 2, 2006, 8 pages.

Measured Liquor Pourers & Liquor Portion Control—Bar Supplies, http://www.servu-online.com/Bar-Supplies/Measured-Liquor-Pourers-and-Liquor-Portion-C . . . , Aug. 2, 2006, 5 pages.

* cited by examiner

PORTION CONTROL PLATE COVER

RELATED APPLICATIONS

This application is a continuation of U.S. application Ser. No, 12/043,320, filed Mar. 6, 2008, now U.S. Pat. No. 8,083,090, which claims priority to U.S. Provisional Application Ser. No. 60/896,343, filed Mar. 22, 2007.

FIELD OF THE INVENTION

The present invention relates generally to food serving devices, and more particularly, to methods and devices for controlling the portions of food served on a plate.

BACKGROUND

Obesity and being overweight have recently become a topic of interest and of much discussion. The increased interest may be attributed, in part, to the suggestion that excess weight may significantly affect a person's health. For example, excess weight may increase the likeliness of many health related problems, such as, high blood pressure, high cholesterol, diabetes, cardiovascular diseases, as well as many others problems.

One or the more common factors contributing to excess weight gain is overeating. To the untrained eye, it can be very challenging to accurately judge the portion size of a meal. In many instances, when uncertain about the portion size, the eye may underestimate the size of the portion, resulting in portions being oversized causing overeating. In addition to overeating, another common factor contributing to excess weight is the lack of a balanced diet. In many instances, it is easy to loose track of the types of food consumed on a daily basis tending to result in people eating more of one food group than another.

However, there are many dieting plans and strategies that could be incorporated into a daily routine to help promote excess weight loss. For example, eating healthier foods, such as increasing the consumption of fruits and vegetables while decreasing the consumption of fatty foods, eating multiple meals small instead of one or two large meals, controlling the portion size in meals, and increasing daily exercise, to name a few. Therefore, it would be desirable to have a device that can help to accurately determine appropriate portion sizes to enhance portion control in the diet and that may help to achieve a more balanced diet.

SUMMARY

The following summary is provided to facilitate an understanding of some of the innovative features unique to the present invention and is not intended to be a full description. A full appreciation of the invention can be gained by taking the entire specification, claims, drawings, and abstract as a whole.

The present invention provides a device and methods for increasing portion control in a diet. In one illustrative embodiment, the portion control device includes a cover member sized to cover at least a portion of the eating surface of a plate. The cover member may include a first surface having one or more openings therein defined by an opening perimeter. One or more compartment walls may be attached to the first surface adjacent to the perimeter of the one or more openings and may extend a distance therefrom. The one or more openings and the one or more compartment walls may define a portion compartment that may help to manage, and in some cases, measure, portions of food. Additionally, in some embodiments, the compartments may have labels indicating the food group to be placed therein to help achieve a balanced diet.

BRIEF DESCRIPTION OF THE DRAWINGS

The invention may be more completely understood in consideration of the following detailed description of various illustrative embodiments of the invention in connection with the accompanying drawings, in which.

DETAILED DESCRIPTION

Figure 1:
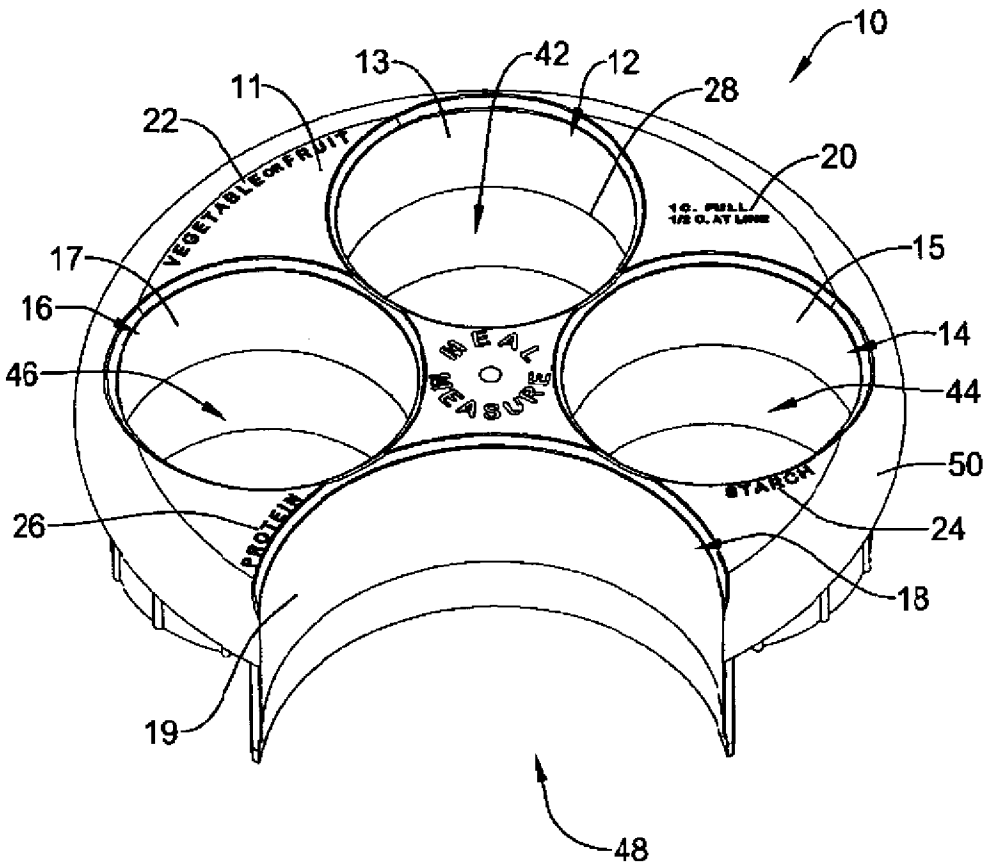
FIG. 1 is a perspective top view of an illustrative embodiment of a portion control device in accordance with the present invention.

The following description should be read with reference to the drawings wherein like reference numerals indicate like elements throughout the several views. The detailed description and drawings show several embodiments which are meant to be illustrative of the claimed invention.

FIG. 1 is a perspective top view of an illustrative embodiment of a portion control device. In the illustrative embodiment, the portion control device includes a portion control cover member 10 sized to cover at least part of the eating surface of a plate (not shown) in order to help manage portion control for meals and, in some cases, achieve a balanced diet. The illustrative cover member 10 may include an upper surface 11 having one or more openings 12, 14, 16, and 18 therethrough and one or more compartment walls 13, 15, 17, and 19. The one or more compartment walls 13, 15, 17, and 19 may extend downward from the one or more openings 12, 14, 16, and 18 in the upper surface 11 and may define one or more portion compartments 42, 44, 46, and 48.

In the illustrative embodiment, the cover member 10 includes an upper surface 11 with one or more openings 12, 14, 16, and 18 therein. In the illustrative example, there are four openings 12, 14, 16, and 18 provided in the upper surface 11. However, it is contemplated that there may be two openings, three openings, five openings, or any number of openings, as desired.

In some embodiments, the openings 12, 14, 16, and 18 may have a perimeter that is substantially circular in shape. However, the openings 12, 14, 16, and 18 may be, for example, square, rectangular, circular, oval, or any other shape or combination of shapes, as desired. In one illustrative example, the openings 12, 14, 16, and 18 may have an opening diameter in the range of 2 to 4 inches. For example, the opening diameter may be about 3 inches, or in one case, about 2.95 inches. However, this is only illustrative and it is contemplated that any suitable size opening may be used, as desired.

As illustrated, opening 18 may be different in both size and shape from the other openings 12, 14, and 16. Opening 18 may be substantially oval-shaped and may extend through the perimeter of the cover member 10. Additionally, opening 18 may have a larger diameter than openings 12, 14, and 16. In some embodiments, this may be due, at least in part, to a greater portion recommendation for one of the food groups. However, this is not required and it is contemplated that all the openings 12, 14, 16, and 18 may be the same size or different sizes, as desired.

In some embodiments, the openings, 12, 14, 16, and 18 may occupy a portion of the total surface area of the upper surface 11. In one case, the one or more openings may occupy about half of the total surface area of the upper surface 11. In other cases, the one or more openings 12, 14, 16, and 18 may occupy more than half of the total surface area. However, it is contemplated that the openings 12, 14, 16, and 18 may occupy any portion of the total surface area of the upper surface 11 of the cover member 10, as desired.

In the illustrative embodiment, the cover member 10 may include one or more compartment walls 13, 15, 17, and 19 that may extend from the one or more openings 12, 14, 16, and 18 in the upper surface 11 to define one or more portion compartments 42, 44, 46, and 48. As illustrated, the compartment walls 13, 15, 17, and 19 may extend at an angle that is about perpendicular to the openings 12, 14, 16 and 18 and around the entire perimeter of the openings 12, 14, 16, and 18. In this configuration, the one or more compartment walls 13, 15, 17, and 19 may be tubular or generally cylindrical in shape.

In some embodiments, as illustrated with portion compartment 48, opening 18 may extend through the perimeter of the upper surface 11. As such, the compartment 48 may have an open side, which, in some cases, may help allow the placement of oddly shaped foods therein. Furthermore, any or all of the portion compartments 42, 44, 46, or 48 may have an open side, if desired.

In some embodiments, the compartment walls 13, 15, 17, and 19 may be coupled or attached to the upper surface 11 of the cover member 10. In one example embodiment, the compartment walls 13, 15, 17, and 19 may be fixedly attached to the upper surface 11 at a location adjacent to a perimeter of the one or more openings 12, 14, 16, and 18. In some cases, the point of attachment between the upper surface 11 and the compartment walls 13, 15, 17, and 19 may be a beveled or rounded, but this is not required. In other cases, the compartment walls 13, 15, 17, and 19 may be tapered at the openings 12, 14, 16, and 18 of the portion compartments 42, 44, 46, and 48, but this is not required.

Figure 7:
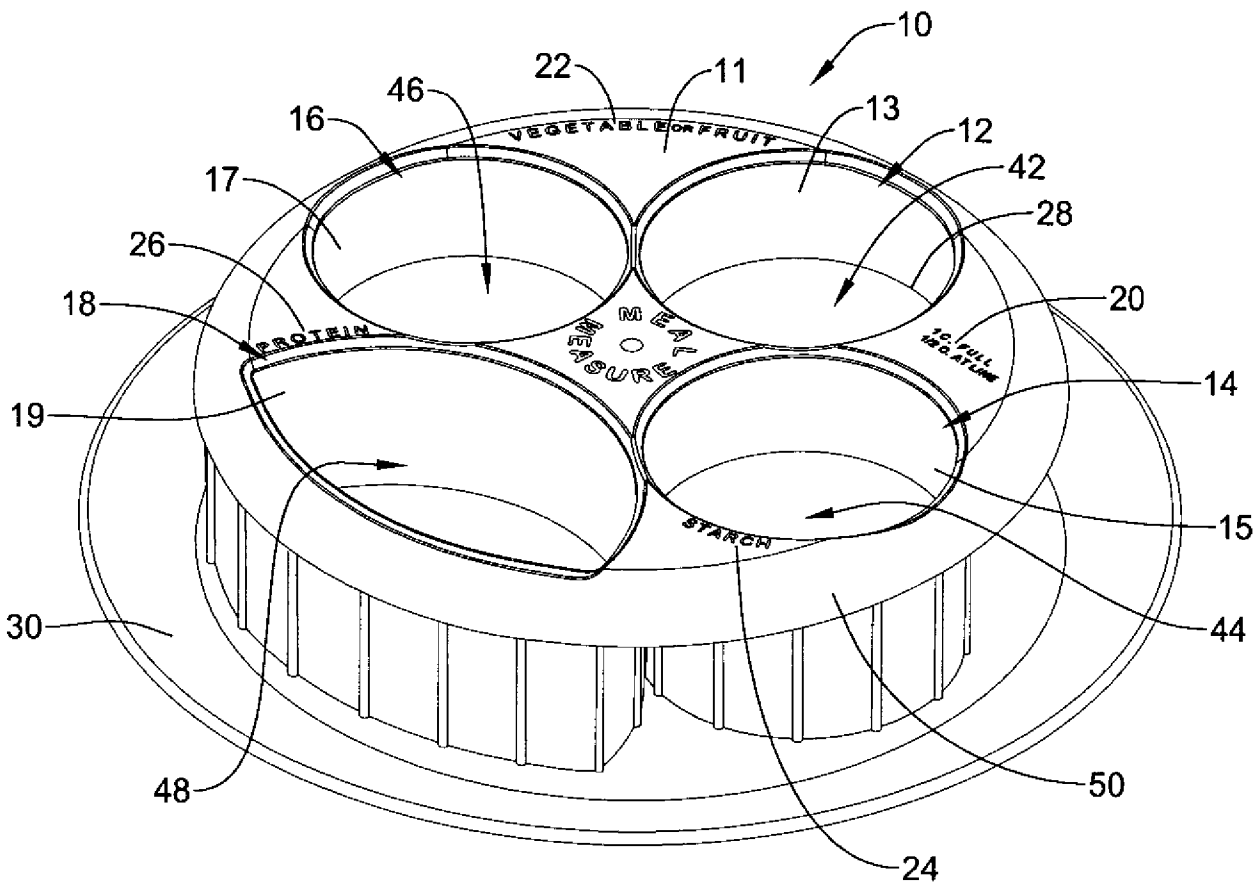
FIG. 7 is a perspective top view of an illustrative embodiment of a portion control device positioned on a plate.

In the illustrative example, the upper surface 11 of the cover member 10 may have a substantially circular perimeter. In some cases, the perimeter may have a shape similar to that of a plate, as seen in FIG. 7, for example. However, it is contemplated that any shaped perimeter may be used, as desired. Additionally, the cover member 10 may have a diameter in the range of 6 to 11 inches. For example, in one embodiment, the cover member 10 may be about 8 inches in diameter. However, this is not meant to be limiting and it is contemplated that any suitable diameter may be used, as desired.

Furthermore, the cover member 10 may include an outer side wall 50 extending around the perimeter of the upper surface 11. As illustrated, the outer side wall 50 may extend downward from the upper surface 11 of the cover member 10. In the illustrative embodiment, the edge between the outer side wall 50 and the upper surface 11 may be a beveled or rounded edge, but this is not required. Furthermore, as will be further described with reference to FIG. 3, the outer side wall 50 may extend downward from the upper surface 11 a distance less than the compartment walls 13, 15, 17, and 19. In some cases, this may be advantageous if the plate that the cover member 10 is positioned on has a raised edge. However, this is not required and any height may be used for the outer side wall 50 and the compartment walls 13, 15, 17, and 19, as desired.

In the illustrative embodiment, the cover member 10 may include one or more labels 22, 24, and 26 for the portion compartments 42, 44, 46, and 48. The labels 22, 24, and 26 may indicate the type of food that should be placed in each of the compartments 42, 44, 46, and 48. For example, in the illustrative embodiment, label 22, adjacent to compartments 42 and 46 reads "VEGETABLE OR FRUIT" and indicates that vegetables or fruit should be placed in compartments 42 and 46. Similarly, label 24 adjacent to compartment 44 reads "STARCH" and indicates that starch foods should be placed in compartment 44. Additionally, label 26 adjacent to compartment 48 reads "PROTEIN" and indicates that a food high in protein should be placed in compartment 48. Furthermore, the labels 22, 24, and 26 illustrated are merely exemplary and the labels may indicate any type of food to be placed in the corresponding compartment or compartments, as desired. For example, the labels could also be "CARBOHYDRATES", "DAIRY", "GRAIN", "MEAT", or any other label, as desired. In some embodiments, the labels may correspond to a diet plan, such as, the South Beach diet, Weight Watchers, the Atkins diet, or any other dieting plan, as desire. The labels may help to balance a person's diet by incorporating food from many different food groups. However, it is contemplated that the labels 22, 24, and 26 may be removed from the cover member 10, if desired.

In some embodiments, the cover member 10 may include a measure indicator, such as, for example, a measuring line 28, but this is not required. In some cases, a key 20 for the measure indicator may also be provided. In the illustrative embodiment, the measure indicator is a measure line 28 on the compartment walls 13, 15, 17, and 19. Additionally, key 20 is provided on the upper surface 11 of the cover member for indicating the measure related to the measure line 28. In the illustrative example, the key indicates that a full compartments may be one cup and a compartment filled to the measure line 28 is one half cup. Furthermore, it is contemplated that any suitable measure indicator, measure indicator size, and/or key may be used, as desired. Additionally, it is contemplated that in some embodiments, the compartment walls 13, 15, 17, and 19 may include multiple measure indicators or measure lines, as desired.

The cover member 10 may be made with a number of suitable materials. In some embodiments, the cover member 10 may include a relatively durable material that may be easily cleaned. In some cases, the cover member 10 may include a material that is dishwasher safe and, in some cases, microwavable safe. For example, the cover member 10 may include a polymer or plastic material. However, it is contemplated that the portion control device may include a metal, such as, for example, stainless steel, a ceramic material, a rubber material, or any suitable material as desired. In some embodiments, the cover member 10 may be manufactured using a molding process, an extrusion process, or any other suitable manufacturing process, as desired.

Figure 2:
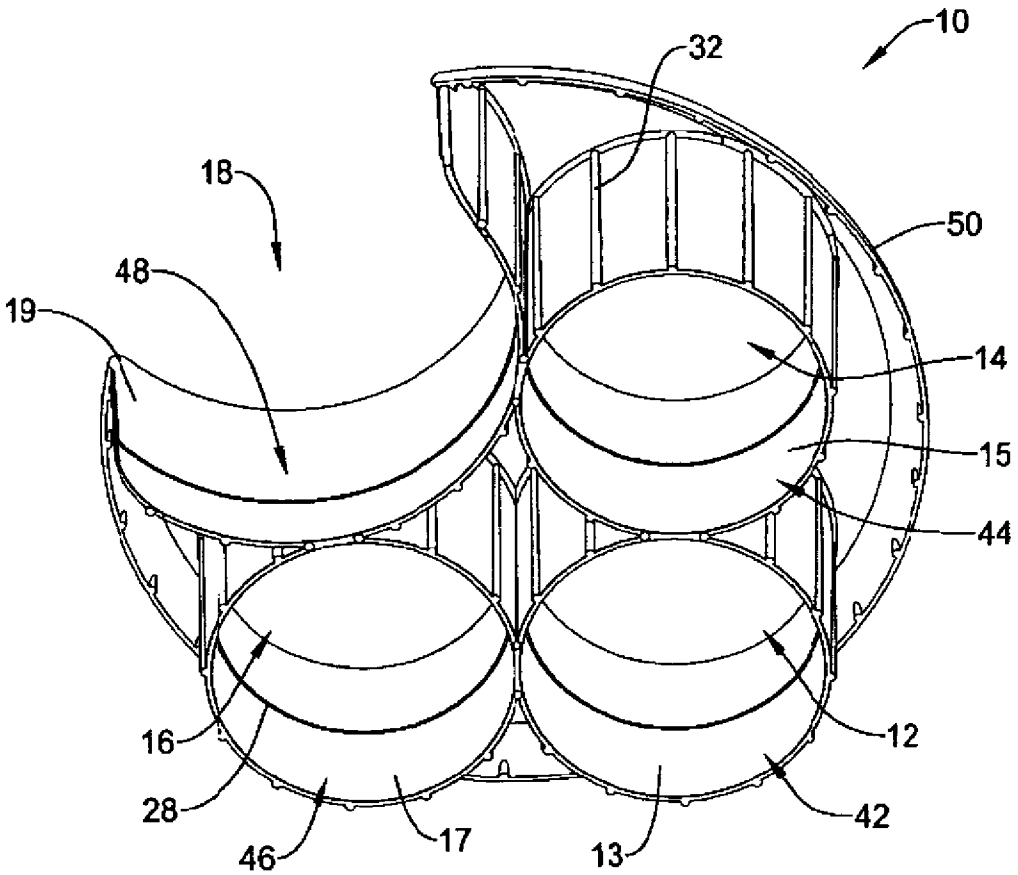
FIG. 2 is perspective bottom view of the illustrative portion control device of FIG. 1.

FIG. 2 is perspective bottom view of the illustrative portion control device of FIG. 1. As illustrated, the portion control device, or cover member 11, includes four compartment walls 13, 15, 17, and 19 defining four portion compartments 42, 44, 46, and 48. Each compartment wall 13, 15, 17, and 19 may include a measure line 28 to help identify the size of the portions. As illustrated, the cover member 10 does not have a bottom surface causing the backside of the compartment walls 13, 15, 17, and 19 to be open. However, it is contemplated that a bottom surface, which may be similar to the upper surface 11, may be provided, if desired.

In the illustrative embodiment, the backside of the compartment walls 13, 15, 17, and 19 may include one or more ribs 32, but this is not required. As illustrated, the ribs 32 extend longitudinally along the compartment walls 13, 15, 17, and 19. In some embodiments, the ribs 32 may provide support for the compartment walls 13, 15, 17, and 19 of the portion control device.

Figure 3:
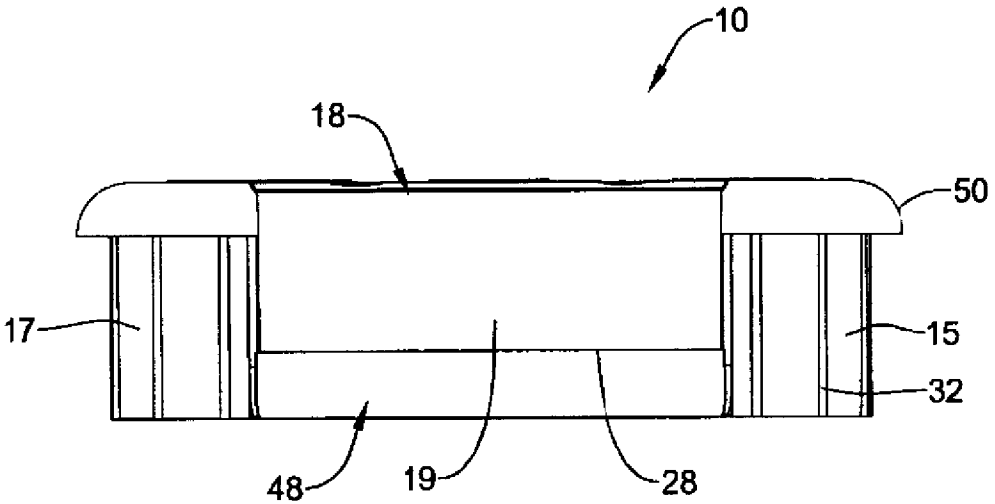
FIG. 3 is a perspective side view of the illustrative portion control device of FIG. 1.

FIG. 3 is a perspective side view of the illustrative portion control device of FIG. 1. As illustrated, the outer side wall 50 may be shorter than the compartment walls 13, 15, 17, and 19. In other words, the outer side wall 50 may only extend a fraction of the distance from the upper surface 11 as the compartment walls 13, 15, 17, and 19. In the illustrative embodiment, the height of the cover member 10, which may correspond to the height of the compartment walls 13, 15, 17, and 19, may be in the range of 1 to 4 inches. In the example embodiment, the height of the cover member 10 may be about two inches, such as, 2.2 inches. However, it is contemplated that any suitable height may be used, as desired. Furthermore, it is contemplated that the compartment walls 13, 15, 17, and 19 may differ in height, if desired.

Figure 4:
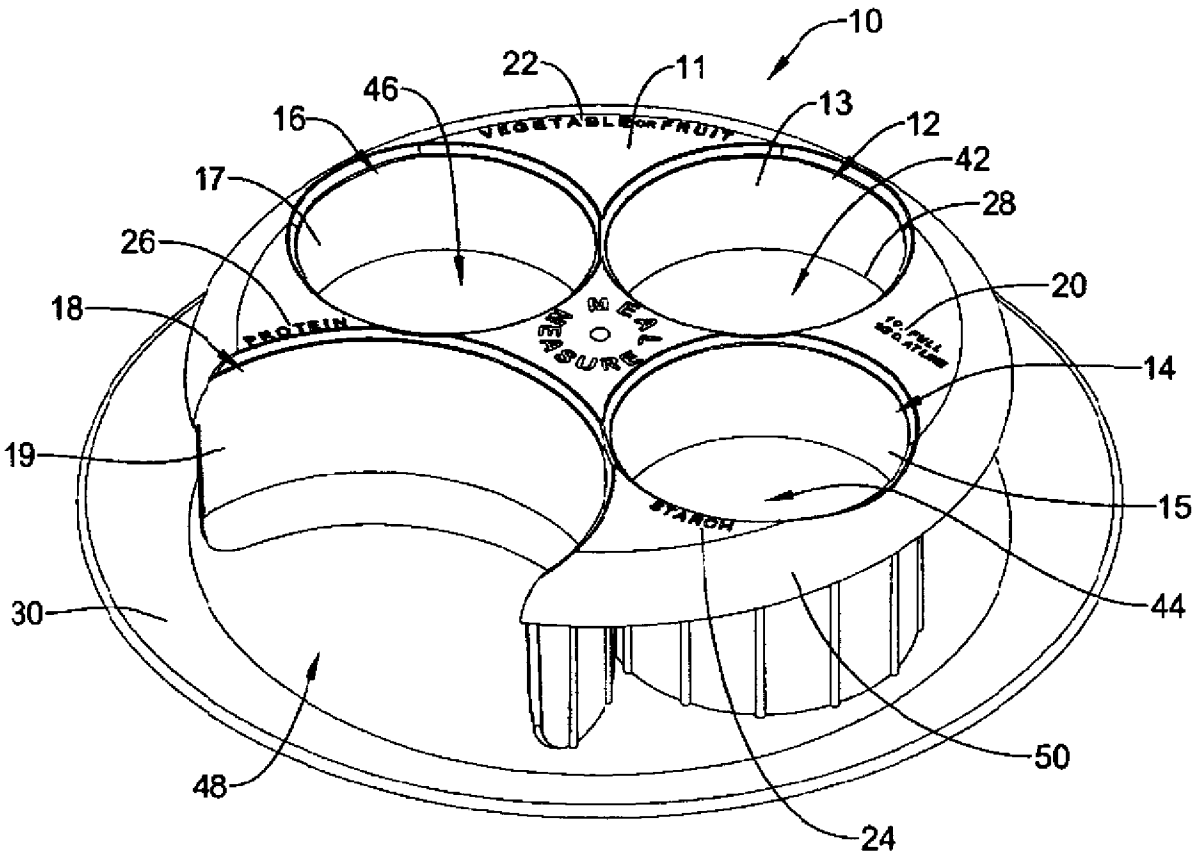
FIG. 4 is a perspective view of the illustrative portion control device of FIG. 1 positioned on a plate.

FIG. 4 is a perspective view of the illustrative cover member 10 of FIG. 1 positioned on a plate. In the illustrative embodiment, the plate may be a dinner plate 30 having an eating surface. As illustrated, the plate 30 may have an outer flange around the outer edge of the plate to. Additionally, as illustrated, the plate 30 may have a larger diameter than that of the cover member 10, but this is not required.

The cover member 10 may be positioned on the plate 30 so that the portion compartments are above the eating surface of the plate 30. In some cases, the cover member 10 may be centered or substantially centered on the plate 30, but this is not required.

In the illustrative embodiments, the bottom edge of the cylindrical walls 13, 15, 17, and 19 is provided to fit to the contour of the eating surface of the plate 30. With this configuration, the food may be less likely to escape underneath the bottom of the cylindrical walls 13, 15, 17, and 19 and result in greater than desired portions of food. However, it is contemplated that any suitable plate 30 and contour of the bottom of the cover member 10 may be used, as desired.

Figure 5:
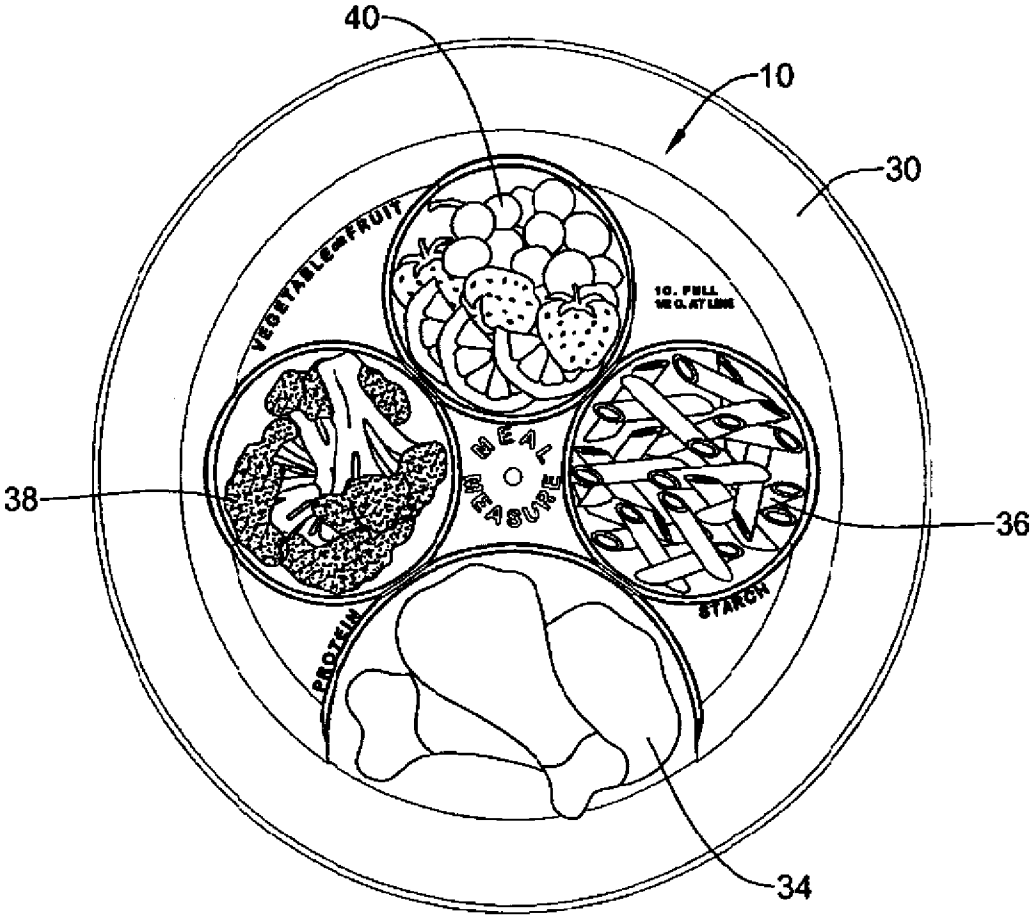
FIG. 5 is a perspective top view of the illustrative portion control device positioned on the plate of FIG. 4 including food in the portion control device.

FIG. 5 is a perspective top view of the illustrative cover member 10 positioned on the plate of FIG. 4 including food in the cover member 10. In the illustrative embodiment, after the cover member 10 has been positioned over the eating surface of the dinner plate 30, food may be placed in the portion compartments, 42, 44, 46, and 48. In the illustrative example, pasta 36, such as penne pasta, may be placed into the starch portion compartment 44, chicken 34 may be placed in the protein portion compartment 48, broccoli 38 may be placed in one of the vegetable or fruit portion compartments 42, and fruit 40, including for example, grapes, oranges, and strawberries, may be placed in the other vegetable or fruit portion compartment 42. However, any suitable food may be placed in any appropriate portion compartment 42, 44, 46, and 48, as desired. For example, any suitable type of meat, fish, or poultry may be placed in the protein compartment. The starch compartment may include pasta, rice, potatoes, bread, or any other starch food, as desired. Additionally, any suitable fruit or vegetable may be placed in the fruit or vegetable compartments, as desired.

In the illustrative embodiment, the compartment labels include protein, starch and fruit or vegetables, and are merely illustrative. It is contemplated that any suitable compartment labels may be used, as desired. The compartment labels may be substituted for any suitable label according to a desired dieting plan. For example, if a diet high in protein and low in carbohydrates is desired, the starch compartment may be substituted with another protein compartment. Additionally, it is contemplated that one of the fruit or vegetable compartments may be substituted with a dairy compartment, if desired. Moreover, the cover member may be adapted to be used with any suitable diet, such as, for example, the Atkins diet, the South Beach diet, weight watchers, or any other diet program, as desired.

Figure 6:
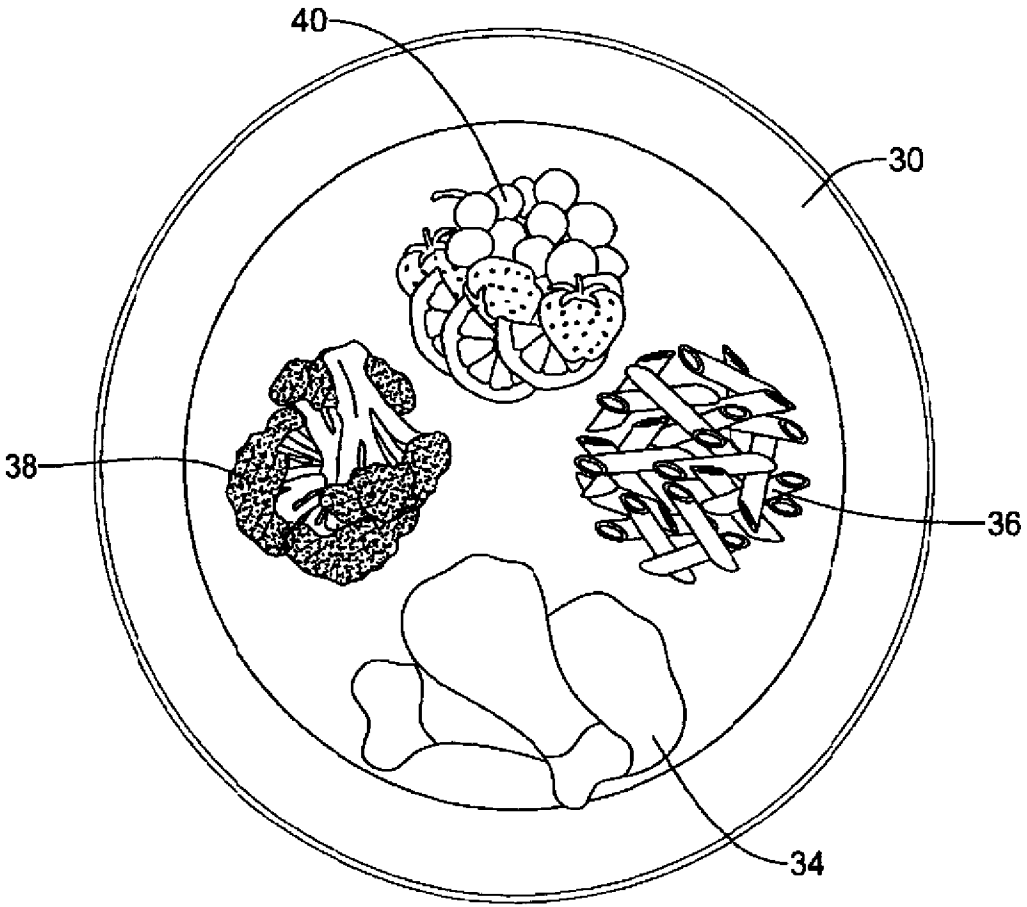
FIG. 6 is a perspective top view of the illustrative plate with the servings of food after the portion control device has been removed.

FIG. 6 is a perspective top view of the illustrative plate with the servings of food after the portion control device has been removed. As can be seen in FIG. 6, the portion control device may help to control the portion size of the food that is placed on the plate 30. After the desired food and portions of food has been placed on the plate 30, as illustrated in FIG. 5, the cover member 10 may be removed from the plate 30. Then, the food is portioned and ready to be eaten. However, it is contemplated that the food may be eaten with the cover member 10 still on the plate 30, if desired.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

The invention claimed is:

1. A removable portion control device for use with a plate, comprising:

a cover member sized to cover at least a portion of the plate, the cover member including:

a first surface having a plurality of openings therein;

a plurality of compartment walls attached to the first surface adjacent to a perimeter of the plurality of openings, the plurality of compartment walls extending a first distance in a first general direction from the first surface; and an outer side wall extending a second distance in the first general direction from the first surface at an outermost perimeter of the first surface;

wherein the second distance is less than the first distance;

wherein the plurality of openings and the plurality of compartment walls define a plurality of discrete portion compartments each defined by one opening and one compartment wall;

wherein an outer shape of the first surface at the outermost perimeter of the first surface corresponds to an outer shape of the plate at an outermost perimeter of the plate;

wherein the plurality of portion compartments cooperate with the plate to define portion sizes;

wherein the cover member is configured to be removed from the plate so as to leave any contents of the plurality of portion compartments on the plate.

2. The portion control device of claim 1, wherein each of the plurality of compartment walls extend at an angle substantially perpendicular to the first surface.

3. The portion control device of claim 2, wherein each of the plurality of openings is substantially circular.

4. The portion control device of claim 3, wherein each of the plurality of compartment walls is tubular-shaped thereby defining substantially tubular-shaped portion compartments.

5. The portion control device of claim 1, wherein the outer side wall extends in the first general direction from the first surface at an angle substantially perpendicular thereto.

6. The portion control device of claim 1, wherein the plurality of openings in the first surface comprises more than half the total surface area of the first surface.

7. The portion control device of claim 1, further comprising a label disposed adjacent to one of the plurality of portion compartments, the label indicating the type of food to be placed in the adjacent portion compartment.

8. The portion control device of claim 1, further comprising at least one label disposed adjacent each of the plurality of portion compartments, the at least one label indicating the type of food to be placed in the portion compartment adjacent to the at least one label.

9. The portion control device of claim 1, wherein at least one of the plurality of compartment walls includes a measure indicator.

10. The portion control device of claim 1, wherein each of the plurality of compartment walls includes a measure indicator.

11. The portion control device of claim 1, wherein the cover member is configured to be removed from the plate at an angle substantially perpendicular to the first surface thereby leaving all contents of the plurality of portion compartments on the plate.

12. A method of controlling food portions on a plate, comprising:

obtaining a cover member including:

a first surface having a plurality of openings therein; and a plurality of compartment walls attached to the first surface adjacent to a perimeter of the plurality of openings, the plurality of compartment walls extending a first distance in a first general direction from the first surface;

wherein the plurality of openings and the plurality of compartment walls define a plurality of portion compartments each defined by one opening and one compartment wall;

positioning the cover member on a top surface of the plate such that the plurality of portion compartments and the top surface of the plate cooperate to define portion sizes;

placing a portion size of food through at least one of the plurality of openings into at least one of the plurality of portion compartments;

removing the cover member from the top surface of the plate so as to leave the food on the top surface of the plate.

13. The method of claim 12, wherein the cover member further includes a label adjacent to each of the plurality of openings, the label indicating a type of food to be placed therein.

14. The method of claim 13, wherein placing a portion size of food further comprises matching a food with the label corresponding to that food prior to placing the portion size of food through the opening adjacent that label.

15. The method of claim 12, wherein each of the plurality of compartment walls includes a measure indicator line.

16. The method of claim 15, wherein placing a portion size of food further comprises measuring the portion size of food using the measure indicator line.

17. The method of claim 12, wherein removing the cover member includes removing the cover member at an angle substantially perpendicular to the top surface thereby leaving all contents of the plurality of portion compartments on the top surface of the plate.

18. The method of claim 12, wherein the plurality of openings in the first surface comprises more than half the total surface area of the first surface.

* * * * *